US005811915A

United States Patent [19]

Abe et al.

[11] Patent Number: 5,811,915

[45] Date of Patent: Sep. 22, 1998

[54] SPARK PLUG INCLUDING ELECTRODE WITH PROTRUDING PORTION FOR HOLDING NOBLE METALLIC CHIP, AND METHOD OF MAKING THE SAME

[75] Inventors: Nobuo Abe, Yokkaichi; Hironori Osamura, Chiryu, both of Japan

[73] Assignee: Denso Corporation, Kariya, Japan

[21] Appl. No.: 728,895

[22] Filed: Oct. 10, 1996

[30] Foreign Application Priority Data

Oct. 11, 1995 [JP] Japan ..... 7-263300

[51] Int. Cl.[6] ..... H01T 13/20; H01T 21/02

[52] U.S. Cl. ..... 313/141; 313/140; 313/141; 445/7

[58] Field of Search ..... 313/139, 140, 313/141; 445/7, 64

[56] References Cited

U.S. PATENT DOCUMENTS 4,853,582 8/1989 Sato et al. ..... 313/141

5,488,262 1/1996 Takamura ..... 313/141

FOREIGN PATENT DOCUMENTS 57-130385 8/1982 Japan .

2-049388 2/1990 Japan .

*Primary Examiner*—Sandra L. O'Shea

*Assistant Examiner*—Joseph Williams

*Attorney, Agent, or Firm*—Cushman Darby & Cushman IP Group of Pillsbury Madison & Sutro LLP

[57] ABSTRACT

Center and earth electrodes are melted at the predetermined regions on the tip thereof where noble metallic chips are fixed. Then, the noble metallic chips are sunk in the melted portions of these center and earth electrodes so as to form protruding portions along outer peripheries of the noble metallic chips. Thus, the noble metallic chips are fixed to the electrodes through the protruding portions. Next, the noble metallic chips are irradiated by energy-condensing light through the protruding portions thus formed. With this irradiation, the center electrode is welded to one noble metallic chip, while the earth electrode is welded to the other noble metallic chip.

20 Claims, 4 Drawing Sheets

SPARK PLUG INCLUDING ELECTRODE WITH PROTRUDING PORTION FOR HOLDING NOBLE METALLIC CHIP, AND METHOD OF MAKING THE SAME

BACKGROUND OF THE INVENTION

1. Field of the Invention

The present invention relates to a spark plug for an internal combustion engine, including a noble metallic chip provided on the tip of at least one of a center electrode and an earth electrode which cooperatively serve as a spark discharge section.

2. Description of the Related Art

Conventional spark plugs for an internal combustion engine, known as having excellent durability, comprise a noble metallic chip 5 fixed on the tip of a center electrode 3 made of Ni-series alloy as shown in FIGS. 4A and 4B. Noble metallic chip 5 is made of Ir or Pt-Ir alloy having an extremely high melting point. According to the spark plug disclosed in the unexamined Japanese patent application No. HEI 2-49388 published in 1990, a bore 3*b* is formed in the top of center electrode 3 as shown in FIG. 4A. A wire-like noble metallic chip 5, made of a Pt-Ir alloy, is press-fitted into this bore 3*b* by using an ultrasonic wave. Thereafter, the noble metallic chip 5 is irradiated by a laser beam (indicated by L in FIG. 4A) along the entire periphery thereof.

Furthermore, according to the unexamined Japanese patent application No. SHO 57-130385 published in 1982, the noble metallic chip 5 is connected on the top of the center electrode 3 through a resistance welding operation, and then the center electrode 3 and the noble metallic chip 5 are securely fixed by applying laser welding along the connecting surface therebetween, as shown in FIG. 4B.

According to the above-described conventional techniques, a fusion layer (indicated by B in FIG. 4B) is formed so as to bridge the center electrode 3 and the noble metallic chip 5 by performing the laser welding operation in addition to the resistance welding operation. The fusion layer thus formed serves as a means for reducing the thermal stress occurring in the welding portion (indicated by S in FIG. 4B) between the center electrode 3 and the noble metallic chip 5 due to the difference in linear expansion coefficient between the center electrode 3 and the noble metallic chip 5.

However, the spark plug shown in FIG. 4A mandatorily requires the process of forming the bore 3*b* on the top of the center electrode 3. Hence, the manufacturing cost is expensive due to the formation of the bore 3*b*. In addition, adopting the ultrasonic press-fitting operation complicates the assembling process, resulting in difficulty in welding the noble metallic chip 5 on the top of the center electrode 3. Furthermore, in the configuration, the bore 3*b* is deep enough to firmly couple with noble the metallic chip 5 and position it accurately. This is disadvantageous in the amount of the noble metallic material used, in view of the fact that the total amount of noble metallic material is substantially determined by the sum of the amount actually required for the spark discharge section and the amount sunk in the bore 3*b*. Thus, the cost is increased. More specifically, the thickness of the noble metallic chip 5 is not smaller than 1 mm, according to the above-described conventional technology.

Furthermore, when the noble metallic chip 5 and the center electrode 3 are melted by laser beam L, the portion irradiated by laser beam L and its vicinity are heated up to the temperature close to the boiling point of the center electrode 3 which has a low melting point. Consequently, the center electrode 3 possibly evaporates. In other words, the fusion layer B comes to lose the component of the center electrode 3, decreasing the effect of suppressing the thermal stress occurring in the welding portion between the noble metallic chip 5 and the center electrode 3. Moreover, evaporation of the center electrode 3 will result in a significant size reduction for the portion applied the laser welding operation. Accordingly, the connecting strength of the above-described welding portion is worsened.

The following things are estimations derived from the result of a study conducted by the inventors of the present invention on the spark plug shown in FIG. 4B.

According to the spark plug shown in FIG. 4B, the laser welding is applied vertically to the noble metallic chip 5 at a position closer to the center of the connecting surface between the noble metallic chip 5 and the center electrode 3. Hence, the fusion layer B formed through this laser welding is confined by the surrounding portion not melted.

As explained above, the center electrode 3 in the fusion layer evaporates and expands its volume, causing a force pressing or pushing its surrounding portion outwardly. After finishing the welding operation, the temperature decreases and the vaporized the center electrode 3 returns to the original solid state while keeping the expanded shape of the surrounding rigid (non-melted) portion. As a result, a cavity having a volume equivalent to the expanded volume is formed inside the center electrode 3 at the welding portion S. Forming such a cavity is disadvantageous in maintaining the connecting strength at an adequate value.

Furthermore, the noble metallic chip 5 and the center electrode 3, before they are welded, each contain numerous micro holes. These micro holes join with each other and grow into a large bubble upon melting of the noble metallic chip 5 and the center electrode 3 in the welding operation. The large bubble thus formed cannot go out of the welding portion S since it is completely confined by the non-melted portion. Thus, a large bubble is left in the welding portion S, reducing the connecting strength between the noble metallic chip 5 and the center electrode 3.

SUMMARY OF THE INVENTION

Accordingly, in view of above-described problems encountered in the related art, a principal object of the present invention is to provide a spark plug for an internal combustion engine which is capable of reducing the thermal stress in the welding portion between the electrode and the noble metallic chip while maintaining a sufficient connecting strength in this welding portion between the electrode and the noble metallic chip, and which is further capable of simplifying the assembling process as well as reducing the manufacturing cost.

In order to accomplish this and other related objects, the present invention provides a spark plug for an internal combustion engine and its manufacturing method having various aspects which will be explained hereinafter together with reference numerals in parentheses which show the correspondence to the components of the preferred embodiments of the present invention described later.

A first aspect of the present invention provides a spark plug for an internal combustion engine comprising a the center electrode (3), an earth electrode (4) and a the noble metallic chip (5, 5) welded to at least one of the center electrode (3) and the earth electrode (4), wherein a protruding portion (3*c*, 4*c*) is formed around an outer periphery of the noble metallic chip (5, 5) by forcibly pressing the noble metallic chip (5, 5) to part of the electrode (3, 4). The the noble metallic chip (5, 5) is held by the electrode (3, 4) through this protruding portion (3*c*, 4*c*). Through the protruding portion (3*c*, 4*c*) thus formed, the noble metallic chip (5, 5) is irradiated by light (L) capable of emitting condensing energy, so that the noble metallic chip (5, 5) can be welded with the electrode (3, 4).

According to the first aspect of the present invention, it becomes possible to perform the positioning and fixing operations at the same time by simply pressing the noble metallic chip (5, 5) to a predetermined fixing position on the electrode (3, 4). It results in the reduction of manufacturing steps in forming the spark plug for an internal combustion engine.

Furthermore, the present invention makes it possible to use a thin disk-shaped the noble metallic chip (5, 5) because it is no longer necessary to insert the noble metallic chip (5, 5) into the deep the bore (refer to FIG. 4A) formed on the top of the electrode (3, 4), although such an engagement is mandatorily required in the previously-described conventional arts. It will be apparent that allowing the use of thin disk-shaped noble metallic chips will lead to a great amount of reduction of material used as the the noble metallic chip (5, 5).

Furthermore, the protruding portion (3*c*, 4*c*) of the present invention is exposed to the outside. Hence, by irradiating the energy-condensing light (L) to this protruding portion (3*c*, 4*c*), both of the protruding portion (3*c*, 4*c*) and the electrode (3, 4) can be vaporized and then evaporated into the outside atmosphere. Accordingly, there is no possibility of causing a cavity in the fusion layer (A, B) or in the vicinity thereof even after the welding operation is finished, although the previously-described conventional arts are subjected to such a problem.

Moreover, the present invention solves the problem of the micro holes residing in the noble metallic chip (5, 5) and electrode (3, 4) before executing the welding operation, because these micro holes can freely depart from the noble metallic chip (5, 5) or electrode (3, 4) and go into the outside atmosphere once they have grown into a large bubble upon melting of the noble metallic chip (5, 5) and electrode (3, 4). Hence, the connecting strength of the welding portion (S, S) between the electrode (3, 4) and the noble metallic chip (5., 5) can be adequately maintained.

Furthermore, forming the protruding portion (3*c*, 4*c*) along the outer periphery of the noble metallic chip (5, 5) makes it possible to smoothly mix the protruding portion (3*c*, 4*c*) with the noble metallic chip (5, 5) when they are melted by receiving the energy from light (L). In other words, it becomes possible to prevent the undesirable reduction of the component of electrode (3, 4) involved in the fusion layer (A, B), while effectively reducing the thermal stress occurring in the welding portion (S, S).

Still further, provision of the protruding portion (3*c*, 4*c*) surely prevents the size reduction of the welding portion (S, S) even if the protruding portion (3*c*, 4*c*) is evaporated more or less. Thus, the connecting strength between the electrode (3, 4) and the the noble metallic chip (5, 5) can be properly maintained.

Yet further, according to a second aspect of the present invention, the protruding portion (3*c*, 4*c*) is formed by bringing the noble metallic chip (5, 5) into contact with the electrode (3, 4), and then melting the electrode (3, 4) at a surface region which is brought into contact with the noble metallic chip (5, 5), thereafter sinking the noble metallic chip (5, 5) in the electrode (3, 4) melted so that part of the melted electrode (3, 4) is raised around the outer periphery of the the noble metallic chip (5, 5).

Accordingly, the noble metallic chip (5,5) can be easily sunk in the electrode (3, 4) since the surface of the electrode (3, 4) brought into contact with the noble metallic chip (5, 5) is melted. Thus, the protruding portion (3*c*, 4*c*) can be easily formed.

Furthermore, according to a third aspect of the present invention, the protruding portion (3*c*, 4*c*) has the height not smaller than 0.1 mm and the width not less than 0.1 mm. With this configuration, reduction of the electrode (3, 4) component in the fusion layer (A, B) can be further effectively prevented. Thus, the thermal stress occurring in the welding portion (S, S) can be effectively reduced.

Yet further, according to a fourth aspect of the present invention, the noble metallic chip (5, 5) is made of the noble metallic material selected from the group consisting of Ir, Ir-Pt, Ir-Pt-Ni, Ir-Rh, Ir-W, Ir-Al, Ir-Si, Ir-Y, Ir-$Y_2O_3$, and the electrode (3, 4) is made of Ni-group heat resisting alloy comprising Fe and Cr.

Still further, according to a fifth aspect of the present invention, the noble metallic chip (5, 5) has a linear expansion coefficient $\alpha$ in a range of $1\times10^{-6}$ to $1\times10^{-5}$, and the electrode (3, 4) is made of a heat resisting alloy having a linear expansion coefficient $\alpha$ not smaller than $13\times10^{-6}$. In short, the present invention makes it possible to obtain a spark plug for an internal combustion engine having an excellent connecting strength between the electrode (3, 4) and the noble metallic chip (5, 5) even if the linear expansion coefficients thereof are largely different as described above.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
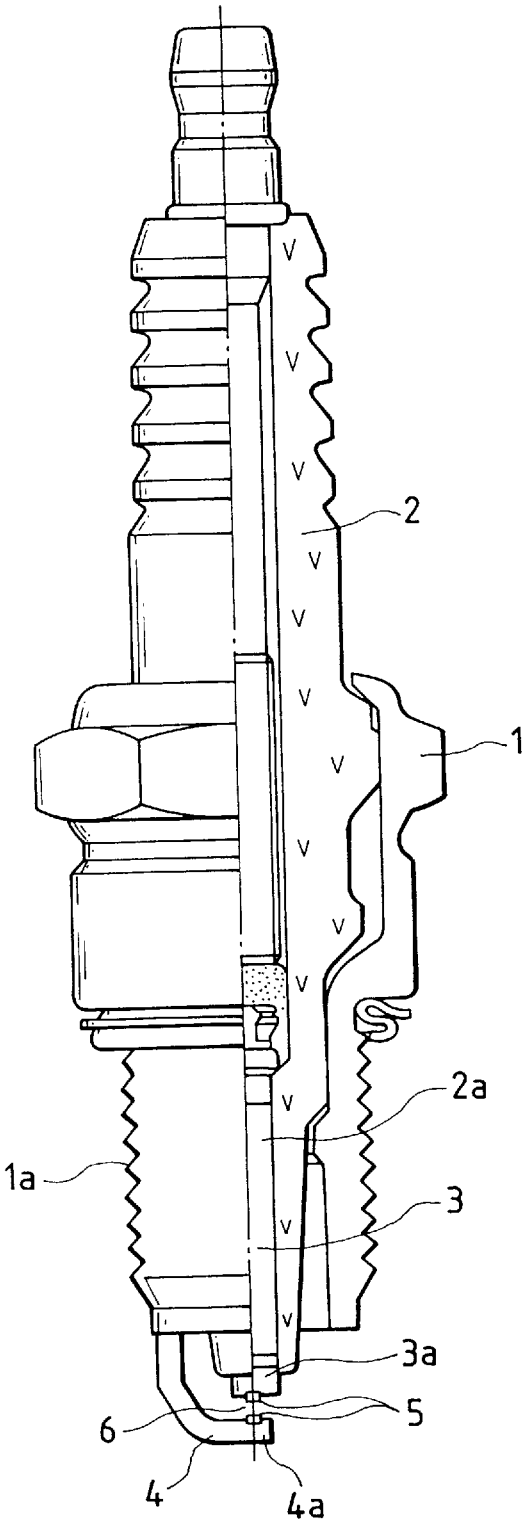
FIG. 1 is a semi-sectional view showing a spark plug for an internal combustion engine in accordance with the present invention.

Preferred embodiments of the present invention will be explained in greater detail hereinafter with reference to the accompanying drawings. Identical parts are denoted by the same reference numerals throughout the views.

FIG. 1 shows a spark plug for an internal combustion engine in accordance with a preferred embodiment of the present invention. In FIG. 1, a housing 1 is cylindrical in shape and is made of heat-resistive, anti-corrosive and electrically-conductive metal. Housing 1 has a screw portion 1*a* which is engageable with an engine block (not shown) to securely install the spark plug on the engine block.

An insulating member 2, made of alumina ceramic etc., is securely accommodated in this housing 1. A the center electrode 3 is fixed in an axial hole 2*a* extending along the axis of this insulating member 2. The the center electrode 3 is made of heat-resistive, anti-corrosive, and electrically-conductive metal, such as heat-resistive nickel-group alloy comprising Fe and Cr (e.g. INCONEL 600 commercially available from Inconel Co., Ltd.: linear expansion coefficient $\alpha=13.3\times10^{-6}$, melting point $T_m=1400°$ C.) Center electrode 3 has a diameter of 2.7 mm. Furthermore, an earth electrode 4 is securely welded to one end of the housing 1. This earth electrode 4 is made of heat-resistive, anti-corrosive, and electrically-conductive metal, too.

Noble metallic chips 5 and 5 are welded on the tip 3*a* of the center electrode 3 and the tip 4*a* of the earth electrode 4, respectively. These the noble metallic chips 5 and 5 are made of heat-resistive, anti-corrosive, and electrically-conductive metal, such as Ir (linear expansion coefficient $\alpha=6.8\times10^{-6}$, melting point $T_m=2{,}450°$ C.), with a diameter of approximately 0.9 mm and a thickness of approximately 0.4 mm.

Figure 2:
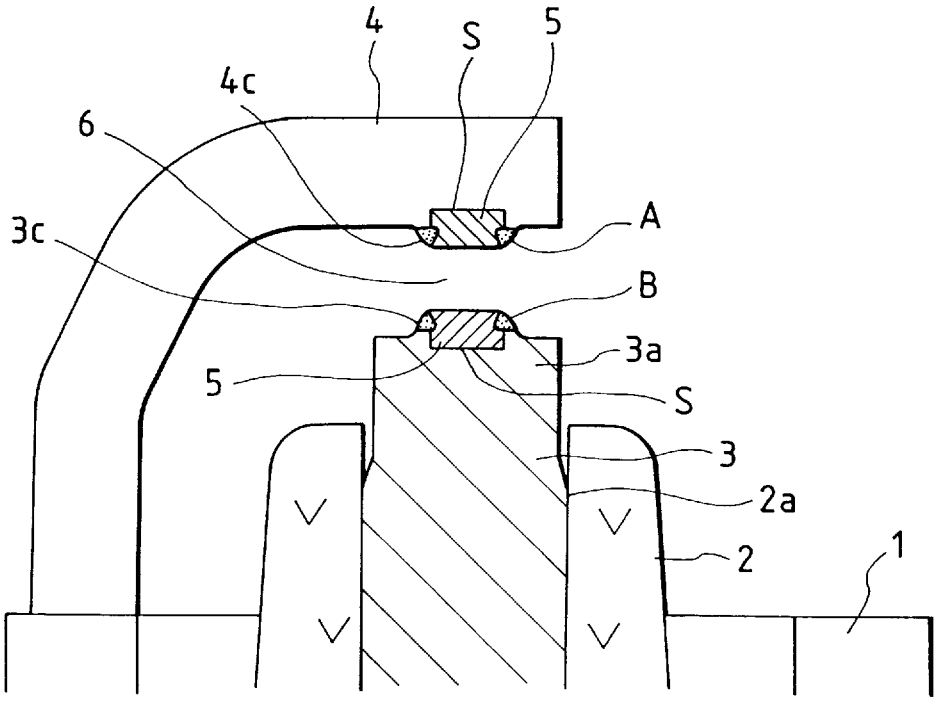
FIG. 2 is an enlarged view showing the detailed arrangement of an essential part of the spark plug shown in FIG. 1.

Furthermore, as shown in FIG. 2, welding portions S and S are respectively characterized by a fusion layer A formed between earth electrode 4 and its associated the noble metallic chip 5 and a fusion layer B formed between the center electrode 3 and its associated the noble metallic chip 5. Both of the fusion layers A and B extend from the cylindrical side wall of the noble metallic chip 5 to the outside, so that fusion layers A and B are exposed to the outside atmosphere.

This welding method and the related structure for fixing the noble metallic chip 5 to the center electrode 3 will be explained in greater detail hereinafter with reference to FIGS. 3A to 3C. The welding method for fixing the noble metallic chip 5 to earth electrode 4, the structure of welding portion S and its vicinity, and their function and effect will not be explained hereinafter because they are substantially identical with those described hereinafter for the center electrode 3.

Figure 3A:
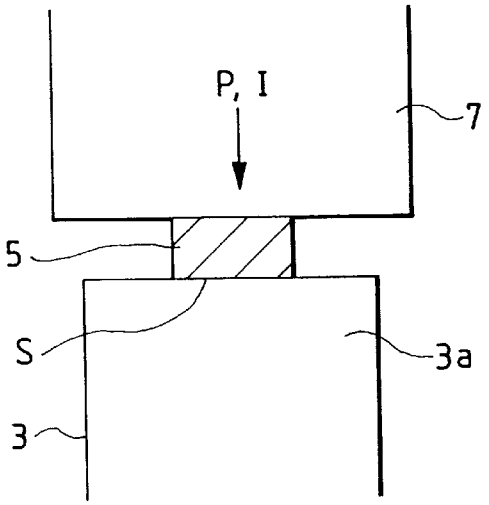
FIGS. 3A through 3C are views sequentially showing a welding method in accordance with the embodiment of the present invention.

First, as shown in FIG. 3A, the noble metallic chip 5 is positioned on the tip 3*a* of the center electrode 3. Then, the resistance welding operation is performed between the center electrode 3 and the noble metallic chip 5 using a welding electrode 7 of a resistance welding machine.

This resistance welding operation is continuously performed during a time equivalent to 10 cycles of an alternate waveform under the condition that pressure P=25 kg/cm$^2$ and the making current I=800 A. In this. case, there is the micro undulation along the contact surface "s" where the noble metallic chip 5 is brought into contact with the center electrode 3 before executing the resistance welding operation. Due to such undulation, the resistance of this contact surface "s" has a very large resistance immediately after starting the resistance welding operation (more specifically, during the time corresponding to the first several cycles of the alternate waveform). Accordingly, this contact surface "s" is subjected to the most severe heat generation.

The center electrode 3 near the contact surface "s" is melted but the noble metallic chip 5 remains unmelted, because the the center electrode 3 has the melting point lower than that of the noble metallic chip 5 as explained above. The the center electrode 3, after it is once melted, is brought into contact by a larger area with the noble metallic chip 5 in a wetted manner, so that the undulation is substantially canceled. Thus, the resistance of the contact surface "s" is steeply reduced.

Then, the noble metallic chip 5 is pushed toward the center electrode 3 by the pressure P applied. As shown in FIG. 3B, the melted the center electrode 3 is extruded around the outer periphery of the noble metallic chip 5, and is raised so as to form the protruding portion 3*c*. By doing so, the noble metallic chip 5 is securely fixed to the center electrode 3. Regarding the protruding portion 4*c* of the earth electrode 4, it is formed in the same manner as shown in FIG. 2.

Figure 3B:
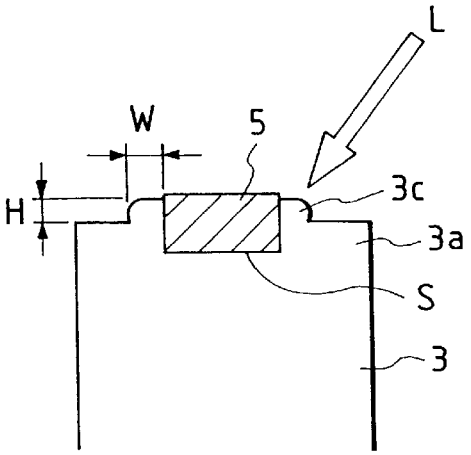

Subsequently, as shown in FIG. 3B, the laser welding is applied along the outer periphery of the noble metallic chip 5. In general, the laser welding is performed by condensing the energy to an intended point of the contact portion between two members, to melt the designated portion and its vicinity, thereby welding these two members. This embodiment uses YAG laser having the irradiation energy of 5J and irradiation time 5 ms with a just focus (0 at the protruding portion 3*c*).

More specifically, the laser beam L is converged to the protruding portion 3*c* or its vicinity of the center electrode 3 at an incident angle 45° with respect to the axis of the center electrode 3. In this manner, the noble metallic chip 5 is irradiated by the laser beam L (i.e. energy-condensing light) through the protruding portion 3*c*. The energy of laser beam L is used to melt the protruding portion 3*c* corresponding to the pointing direction of arrow L, and to melt the tip 3*a* of the center electrode 3 and the central portion of the side surface of the noble metallic chip 5 in the vicinity of the above protruding portion 3*c*. These melted portions can be mixed each other since the protruding portion 3*c* of the melted the center electrode 3 covers the melted the noble metallic chip 5.

Figure 3C:
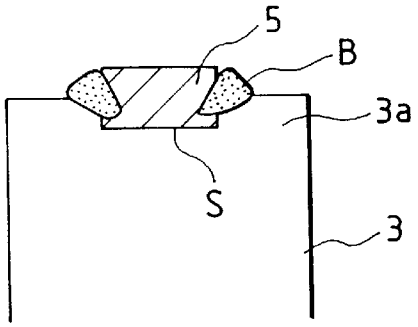

Accordingly, as shown in FIG. 3C, the fusion layer B is formed at the portion corresponding to the pointing direction of arrow L. More specifically, fusion layer B substantially extends from the cylindrical side wall of the noble metallic chip 5 through the protruding portion 3*c* to the outside along the pointing direction of the energy-condensing light L.

Figure 3D:
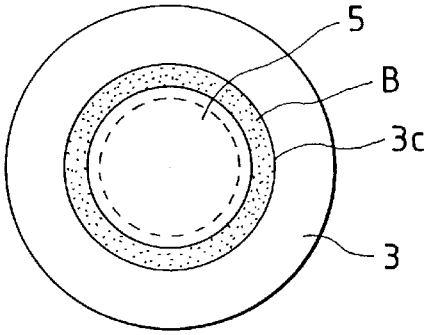
FIG. 3D is a plan view showing one embodiment of the present invention.

The the center electrode 3 and the noble metallic chip 5 are effectively mixed in this fusion layer B. Then, the above-described laser welding is performed entirely along the outer periphery of the noble metallic chip 5 by rotating the center electrode 3 about its axis. By doing so, the fusion layer B is formed along the entire periphery of the noble metallic chip 5 as shown in FIG. 3D.

This fusion layer B has the linear expansion coefficient whose value is somewhere between those of the center electrode 3 the and noble metallic chip 5; therefore, it becomes possible to reduce the thermal stress occurring at the welding portion S when the spark plug for an internal combustion engine is repetitively used.

The function and effect of the embodiment of the present invention will be explained, hereinafter.

According to the above-described embodiment, the protruding portion 3*c* can be formed by sinking the noble metallic chip 5 into the center electrode 3 by applying resistance welding. And, the the noble metallic chip 5 can be easily fixed by the protruding portion 3*c* thus formed. By doing so, it becomes possible to reduce one step in the assembling process of fixing the noble metallic chip 5 to the center electrode 3.

Furthermore, by applying the laser welding through the protruding portion 3*c*, it becomes possible to form the fusion layer B which is capable of effectively reducing the thermal stress occurring in the welding portion S between the noble metallic chip 5 and the center electrode 3. In other words, the protruding portion 3*c* of the present embodiment has a function of forming the fusion layer B as well as a function of fixing the noble metallic chip 5.

Figure 4A:
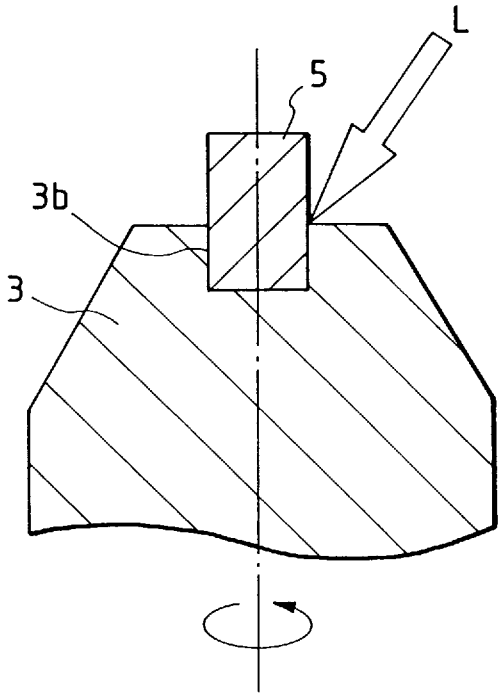
FIG. 4A PRIOR ART
FIGS. 4A and 4B are enlarged views showing a conventional spark plug for an internal combustion engine.
Figure 4B:
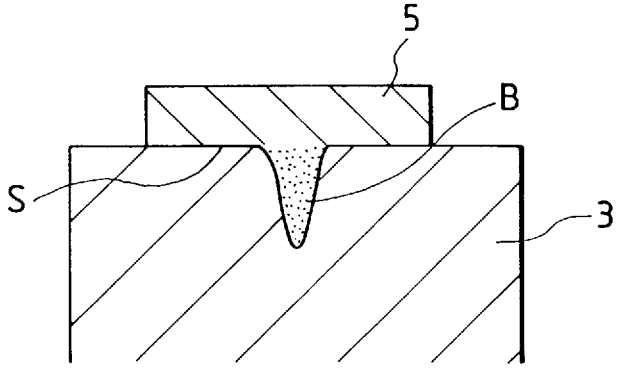
FIG. 4B PRIOR ART

Furthermore, according to the conventional arts, it was required that the noble metallic chip 5 have a thickness more than 1 mm in view of the necessity of deeply inserting or engaging the noble metallic chip 5 in the bore (refer to FIG. 4A) formed on the center electrode 3. In this respect, the present embodiment allows the thin the noble metallic chip 5 having the thickness of approximately 0.4 mm to be used, leading to a great reduction of the amount of material of the noble metallic chip 5.

Furthermore, the protruding portion 3*c* of the present embodiment is exposed to the outside. Hence, by irradiating the laser beam L, both of the protruding portion 3*c* and the center electrode 3, if they are vaporized, can be evaporated into the outside atmosphere. Accordingly, there is no possibility of causing a cavity in the fusion layer B or in the vicinity thereof even after the welding operation is finished, although the previously-described conventional arts are subjected to such a problem. Moreover, the present embodiment solves the problem of the micro holes residing in the noble metallic chip 5 and the electrode 3 before executing the .welding operation, because these micro holes can freely depart from the noble metallic chip 5 or the electrode 3 and go into the outside atmosphere once they grew into a large bubble upon melting of the noble metallic chip 5 and the electrode 3.

Furthermore, irradiating laser beam L to the noble metallic chip 5 through the protruding portion 3*c* is advantageous in that the component of the center electrode 3 involved in the fusion layer B is not reduced. Still further, although laser beam L may induce a more or less amount of vaporization, swelling of the protruding portion 3*c* is effective to prevent the undesirable size reduction in the welding portion S.

With the fusion layer B thus formed, it becomes possible to reduce the thermal stress caused in the welding portion S and properly maintain the connecting strength between the center electrode 3 and the noble metallic chip 5.

Yet further, according to the welding method of the above-described embodiment, the noble metallic chip 5 and the center electrode 3, which are largely different from each other in their linear expansion coefficient $\alpha$, can be assembled firmly with an excellent connecting strength.

Assuming that H and W represent the height and the width of the protruding portion 3*c* as shown in FIG. 3B, determining the size of the protruding portion 3*c* as satisfying $H \geqq 0.1$ mm and $W \geqq 0.1$ mm will make it possible to smoothly mix the protruding portion 3*c* and the noble metallic chip 5 in the laser welding operation. With such size settings, it becomes possible to further eliminate the possibility of losing the component of the center electrode 3 involved in fusion layer B thus formed. Accordingly, the fusion layer B effectively reduces the thermal stress occurring in the welding portion S.

Figure 3E:
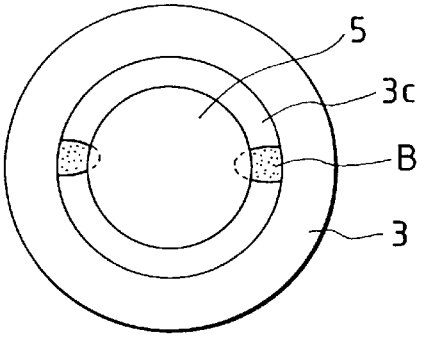
FIG. 3E is a plan view showing another embodiment.

Although the laser welding operation is performed along the entire periphery of the noble metallic chip 5 according to the above-described embodiment, it is needless to say that the present invention is not limited to this arrangement. For example, as shown in FIG. 3E, it will be possible to apply the laser welding operation at only two points on the outer periphery of the noble metallic chip 5. Alternatively, the laser welding can be applied at three points or more.

Furthermore, according to the above-described embodiment, the center electrode 3 is made of heat-resistive nickel-group alloy (INCONEL 600 commercially available from Inconel Co., Ltd.) and the noble metallic chip 5 is made of Ir. However, the present invention is not limited to these materials. The center electrode 3 can be made of other heat-resistive alloy material. And, the noble metallic chip 5 can be made of other the noble metallic material selected from the group consisting of Pt (linear expansion coefficient $\alpha=9\times10^{-6}$, melting point $T_m=1{,}770°$ C.), 20Ir-80Pt (linear expansion coefficient $\alpha=8.4\times10^{-6}$, melting point $T_m=1{,}850°$ C.), 80Pt-20Ni (linear expansion coefficient $\alpha=9.4\times10^{-6}$, melting point $T_m=1{,}550°$ C.), Ir-Pt, Ir-Pt-Ni, Ir-Rh, Ir-W, Ir-Al, Ir-S, Ir-Y, Ir-Y, Ir-$Y_2O_3$.

Moreover, according to the above-described embodiment, the laser welding is used as welding capable of condensing energy. The present invention is, however, not limited to this laser welding. For example, electron beam welding can be used as an alternative welding technique capable of condensing energy.

As this invention may be embodied in several forms without departing from the spirit of essential characteristics thereof, the present embodiments described are therefore intended to be only illustrative and not restrictive, since the scope of the invention is defined by the appended claims rather than by the description preceding them, and all changes that fall within the metes and bounds of the claims, or equivalents of such metes and bounds, are therefore intended to be embraced by the claims.

What is claimed is:

1. A spark plug for an internal combustion engine comprising a the center electrode, an earth electrode and a noble metallic chip welded to at least one of said the center electrode and said earth electrode, wherein a protruding portion is formed around an outer periphery of said noble metallic chip by forcibly pressing said noble metallic chip to part of said at least one of said the center electrode and said earth electrode, so that said protruding portion holds said noble metallic chip on said at least one of said the center electrode and said earth electrode, and said noble metallic chip is welded to said electrode by irradiating energy-condensing light to said noble metallic chip through said protruding portion.

2. The spark plug for an internal combustion engine in accordance with claim 1, wherein said protruding portion is formed by bringing said noble metallic chip into contact with said at least one electrode, and melting said at least one electrode at a surface brought into contact with said noble metallic chip, then sinking said noble metallic chip in the melted portion of said at least one electrode so that the melted portion of said at least one electrode is raised around the outer periphery of said noble metallic chip.

3. The spark plug for an internal combustion engine in accordance with claim 1, wherein said protruding portion has a height not smaller than 0.1 mm and a width not less than 0.1 mm.

4. The spark plug for an internal combustion engine in accordance with claim 1, wherein said noble metallic chip is made of a noble metallic material selected from the group consisting of Ir, Ir-Pt, Ir-Pt-Ni, Ir-Rh, Ir-W, Ir-Al, Ir-Si, Ir-Y, and Ir-$Y_2O_3$, and said at least one electrode is made of a Ni-group heat resisting alloy.

5. The spark plug for an internal combustion engine in accordance with claim 1, wherein said noble metallic chip has a linear expansion coefficient $\alpha$ in a range of $1\times10^{-6}$ to $1\times10^{-5}$, and said at least one electrode is made of a Ni-group heat resisting alloy having a linear expansion coefficient $\alpha$ not smaller than $13\times10^{-6}$.

6. A spark plug for an internal combustion engine comprising:

a pair of electrodes serving as a spark discharge section;

a noble metallic chip welded to at least one of said electrodes;

a protruding portion formed around an outer periphery of said noble metallic chip, said protruding portion being extruded from the tip of said at least one electrode to hold said noble metallic chip; and a fusion layer comprising part of said noble metallic chip and part of said at least one electrode which are fused and mixed with each other, said fusion layer extending from said noble metallic chip to the outside of said protruding portion so that said fusion layer is exposed to the outside atmosphere.

7. The spark plug for an internal combustion engine in accordance with claim 6, wherein said protruding portion has a height not smaller than 0.1 mm and a width not less than 0.1 mm.

8. The spark plug for an internal combustion engine in accordance with claim 6, wherein said noble metallic chip is made of a noble metallic material selected from the group consisting of Ir, Ir-Pt, Ir-Pt-Ni, Ir-Rh, Ir-W, Ir-Al, Ir-Si, Ir-Y, and Ir-$Y_2O_3$, and said at least one of said the center electrode and said earth electrode is made of a Ni-group heat resisting alloy.

9. The spark plug for an internal combustion engine in accordance with claim 6, wherein said noble metallic chip has a linear expansion coefficient $\alpha$ in a range of $1\times10^{-6}$ to $1\times10^{-5}$, and said at least one of said the center electrode and said earth electrode is made of a Ni-group heat resisting alloy having a linear expansion coefficient $\alpha$ not smaller than $13\times10^{-6}$.

10. A manufacturing method for making a spark plug used in an internal combustion engine comprising the steps of:

melting part of an electrode at a predetermined region where a noble metallic chip is fixed;

sinking said noble metallic chip into the melted portion of said electrode by applying a pressing force;

forming a protruding portion around an outer periphery of said noble metallic chip by extruding the melted portion of said electrode when said noble metallic chip is sunk in said melted portion of said electrode; and fusing said noble metallic chip with said electrode by irradiating energy-condensing light to said noble metallic chip through said protruding portion.

11. A spark plug for an internal combustion engine comprising:

a spark discharge section comprising first and second electrodes;

a noble metallic chip directly welded to said first electrode, said first electrode having a protruding portion extruded therefrom so as to be in direct contact with an outer periphery of said noble metallic chip and hold said noble metallic chip to said first electrode; and a fusion layer comprising inter-fused and inter-mixed portions of said noble metallic chip and said first electrode, said fusion layer extending from said the noble metallic chip to an outer region of said protruding portion so that said fusion layer is exposed to the outside atmosphere.

12. The spark plug for an internal combustion engine in accordance with claim 11, wherein said protruding portion has a height not small than 0.1 mm and a width not less than 0.1 mm.

13. The spark plug for an internal combustion engine in accordance with claim 11, wherein said the noble metallic chip is made of a the noble metallic material selected from the group consisting of Ir, Ir-Pt, Ir-Pt-Ni, Ir-Rh, Ir-W, IrAl, Ir-Si, Ir-Y, and Ir-$Y_2O_3$, and said first electrode is made of a Ni-group heat resisting alloy.

14. The spark plug for an internal combustion engine in accordance with claim 11, wherein said the noble metallic chip has a linear expansion coefficient $\alpha$ in a range of $1\times10^{-6}$ to $1\times^{-5}$, and said first electrode is made of a Ni-group heat resisting alloy having a linear expansion coefficient $\alpha$ not smaller than $13\times10^{-6}$.

15. The spark plug for an internal combustion engine in accordance with claim 11, wherein said the noble metallic chip has a uniform composition.

16. The spark plug for an internal combustion engine in accordance with claim 11, wherein said the noble metallic chip and said fusion layer are a first the noble metallic chip and a first fusion layer, respectively, and wherein said spark plug further comprises:

a second the noble metallic chip directly welded to said second electrode, said second electrode having a protruding portion extruded therefrom so as to be in direct contact with an outer periphery of said second the noble metallic chip and hold said second the noble metallic chip to said second electrode; and a second fusion layer comprising inter-fused and inter-mixed portions of said second the noble metallic chip and said second electrode, said second fusion layer extending from said second the noble metallic chip to an outer region of said protruding portion of said second electrode so that said second fusion layer is exposed to the outside atmosphere.

17. The spark plug for an internal combustion engine in accordance with claim 16, wherein said protruding portion of said second electrode has a height not small than 0.1 mm and a width not less than 0.1 mm.

18. The spark plug for an internal combustion engine in accordance with claim 16, wherein said second the noble metallic chip is made of a the noble metallic material selected from the group consisting of Ir, Ir-Pt, Ir-Pt-Ni, Ir-Rh, Ir-W, IrAl, Ir-Si, Ir-Y, and Ir-$Y_2O_3$, and said second electrode is made of a Ni-group heat resisting alloy.

19. The spark plug for an internal combustion engine in accordance with claim 16, wherein said second the noble metallic chip has a linear expansion coefficient $\alpha$ in a range of $1\times10^{-6}$ to $1\times10^{-5}$, and said second electrode is made of a Ni-group heat resisting alloy having a linear expansion coefficient $\alpha$ not smaller than $13\times10^{-6}$.

20. The spark plug for an internal combustion engine in accordance with claim 16, wherein said second the noble metallic chip has a uniform composition.

* * * * *